US005983469A

United States Patent [19]

Beaty et al.

[11] Patent Number: 5,983,469

[45] Date of Patent: Nov. 16, 1999

[54] UNIFORMITY AND PRODUCT IMPROVEMENT IN LYOCELL FABRICS WITH HYDRAULIC FLUID TREATMENT

[75] Inventors: James T. Beaty, Huntersville; Frank E. Malaney, Charlotte, both of N.C.; Herschel Sternlieb, Brunswick, Me.; John Michael Greenway, Westwood, Mass.; Jackson Lawrence, Nashville, N.C.

[73] Assignee: BBA Nonwovens Simpsonville, Inc., Simpsonville, S.C.

[21] Appl. No.: 08/751,071

[22] Filed: Nov. 15, 1996

Related U.S. Application Data

[60] Provisional application No. 60/006,942, Nov. 17, 1995.

[51] Int. Cl.[6] ..... D06B 1/02

[52] U.S. Cl. ..... 28/167; 28/105; 28/163

[58] Field of Search ..... 28/103, 104, 105, 28/167, 168, 169, 162, 163, 271, 283, 247; 26/27, 29 R, 92; 68/205 R, 200, 201, 204; 8/151, 147

[56] References Cited

U.S. PATENT DOCUMENTS

| | | | |
|---|---|---|---|
| 2,150,652 | 3/1939 | Foster | 28/1 |
| 2,317,375 | 4/1943 | Graham | 28/74 |
| 2,338,983 | 1/1944 | Thackston et al. | 26/18.5 |
| 2,342,746 | 2/1944 | Masland, II et al. | 28/75 |
| 2,372,048 | 3/1945 | Auxier | 154/2.6 |
| 2,561,449 | 7/1951 | Ruderman | 154/43 |
| 2,583,855 | 1/1952 | Kenis | 117/126 |
| 2,688,006 | 8/1954 | Steinman | 260/29.6 |
| 2,810,646 | 10/1957 | Wooding et al. | 92/3 |
| 2,911,747 | 11/1959 | Sundt | 41/4 |
| 2,981,999 | 5/1961 | Russell | 28/1 |
| 2,991,537 | 7/1961 | Moler et al. | 28/72.2 |
| 3,010,179 | 11/1961 | Thal | 28/72 |
| 3,060,549 | 10/1962 | Horton | 28/74 |
| 3,085,027 | 4/1963 | Porteous | 117/68 |

(List continued on next page.)

FOREIGN PATENT DOCUMENTS

| | | |
|---|---|---|
| 974745 | 1/1975 | Canada . |
| 1025013 | 1/1978 | Canada . |
| 0-010-546-A1 | 5/1980 | European Pat. Off. . |
| 0-177-277-A1 | 4/1986 | European Pat. Off. . |
| 0-193-078-A1 | 9/1986 | European Pat. Off. . |
| 25-46-642 | 4/1977 | Germany . |
| 54-11433 | 5/1979 | Japan . |
| 57-22692 | of 1982 | Japan . |
| 57-35051 | 2/1982 | Japan . |

(List continued on next page.)

OTHER PUBLICATIONS

Boyes, Kathleen, "Wonder Fiber", *New York Newsday*, Style Section, B21, (Apr. 13, 1995) (Courtaulds Fibers Inc. materials).

Courtaulds Fibers Inc. Technical Manual, § 6.3, "Dyeing and Finishing: Dyeing and Finishing Tencel Fabrics in Garment Form" (Sep. 1996).

Courtaulds Fibers Inc., "Dyeing and Finishing Tencel® Fabrics in Garment Form" (undated).

Courtaulds Fibers Inc., "Experience Nature's Luxury Fiber," Tencel®, (Brochure) (undated).

Courtaulds Fibers Inc., If Clothing is Important to You, Then you Should Know About Tencel®, (Pamphlet) (Jan. 1995).

Courtaulds Fibers Inc., "Tencel® Fiber: Too Good to be True," (Brochure) (undated).

(List continued on next page.)

*Primary Examiner*—Amy B. Vanatta

*Attorney, Agent, or Firm*—Ostrager Chong Flaherty & Onofrio, P.C.

[57] ABSTRACT

A suede-like micro-fibril finish is imparted to fibrillatable cellulosic materials by open width hydraulic treatment. Additional enhancement of the fabric finish is obtained by post hydraulic enzyme and wet processing treatments. Fluid treated fabrics of the invention are characterized by substantially uniform fibrillation of fibers within the fabric body and surface areas.

35 Claims, 10 Drawing Sheets

U.S. PATENT DOCUMENTS

| | | | |
|---|---|---|---|
| 3,113,349 | 12/1963 | Nottebohm et al. | 19/161 |
| 3,449,809 | 6/1969 | Shin | 28/72.2 |
| 3,485,706 | 12/1969 | Evans | 161/72 |
| 3,485,708 | 12/1969 | Ballou et al. | 161/72 |
| 3,485,709 | 12/1969 | Evans et al. | 28/105 |
| 3,493,462 | 2/1970 | Bunting, Jr. | 161/169 |
| 3,494,821 | 2/1970 | Evans | 161/169 |
| 3,503,134 | 3/1970 | Fleissner | 34/12 |
| 3,613,999 | 10/1971 | Bently et al. | 239/553.3 |
| 3,617,613 | 11/1971 | Benzinger | 174/68.5 |
| 3,620,903 | 11/1971 | Bunting, Jr. et al. | 161/169 |
| 3,655,327 | 4/1972 | Rollins | 28/155 |
| 3,733,239 | 5/1973 | George | 161/89 |
| 3,781,950 | 1/1974 | Katsuyama et al. | 28/103 |
| 3,895,158 | 7/1975 | Gause et al. | 428/220 |
| 3,966,519 | 6/1976 | Mitchell et al. | 28/104 |
| 4,069,563 | 1/1978 | Contractor et al. | 28/105 |
| 4,087,993 | 5/1978 | Sando et al. | 68/18 R |
| 4,092,453 | 5/1978 | Jonda | 428/255 |
| 4,109,353 | 8/1978 | Mitchell et al. | 28/104 |
| 4,190,695 | 2/1980 | Niederhauser | 428/234 |
| 4,233,349 | 11/1980 | Niederhauser | 428/92 |
| 4,290,766 | 9/1981 | Burns, Jr. et al. | 8/491 |
| 4,291,442 | 9/1981 | Marco | 28/159 |
| 4,304,813 | 12/1981 | Elmore, Jr. | 428/253 |
| 4,314,002 | 2/1982 | Oizumi et al. | 428/414 |
| 4,389,453 | 6/1983 | Kitanaka et al. | 428/240 |
| 4,407,883 | 10/1983 | Newton | 428/215 |
| 4,428,995 | 1/1984 | Yokono et al. | 428/193 |
| 4,452,847 | 6/1984 | Siemon | 428/246 |
| 4,476,186 | 10/1984 | Kato et al. | 28/104 |
| 4,477,512 | 10/1984 | Thomas et al. | 428/236 |
| 4,477,951 | 10/1984 | Geyer, Jr. et al. | 28/246 |
| 4,497,095 | 2/1985 | Minemura et al. | 26/2 R |
| 4,497,097 | 2/1985 | Schneider et al. | 28/112 |
| 4,501,787 | 2/1985 | Marchetti et al. | 428/236 |
| 4,513,055 | 4/1985 | Leibowitz | 428/245 |
| 4,519,804 | 5/1985 | Kato et al. | 8/485 |
| 4,532,173 | 7/1985 | Suzuki et al. | 428/218 |
| 4,543,113 | 9/1985 | Forester et al. | 55/378 |
| 4,550,051 | 10/1985 | Spielau et al. | 428/285 |
| 4,563,385 | 1/1986 | Bhatt et al. | 428/251 |
| 4,591,513 | 5/1986 | Suzuki et al. | 427/200 |
| 4,643,736 | 2/1987 | Cholley . | |
| 4,665,597 | 5/1987 | Suzuki et al. | 28/104 |
| 4,684,569 | 8/1987 | McGee, Jr. | 428/286 |
| 4,707,565 | 11/1987 | Kasai et al. | 174/68.5 |
| 4,741,075 | 5/1988 | Taguchi et al. | 28/104 |
| 4,743,483 | 5/1988 | Shimizu et al. | 428/89 |
| 4,770,922 | 9/1988 | Hatakeyama et al. | 428/211 |
| 4,789,770 | 12/1988 | Kasner et al. | 219/121.7 |
| 4,805,275 | 2/1989 | Suzuki et al. | 28/104 |
| 4,808,467 | 2/1989 | Suskind et al. | 28/104 |
| 4,828,174 | 5/1989 | Love, III | 239/11 |
| 4,833,005 | 5/1989 | Klaar et al. | 428/224 |
| 4,836,507 | 6/1989 | Yang | 264/143 |
| 4,880,168 | 11/1989 | Randall, Jr. | 239/553.5 |
| 4,900,614 | 2/1990 | Miyazato et al. | 428/251 |
| 4,921,735 | 5/1990 | Block | 428/34.9 |
| 4,932,107 | 6/1990 | Gotoh et al. | 28/137 |
| 4,937,925 | 7/1990 | McGee, Jr. | 28/112 |
| 4,939,016 | 7/1990 | Radwanski et al. | 28/104 |
| 4,960,630 | 10/1990 | Greenway et al. | 428/131 |
| 4,967,456 | 11/1990 | Sternlieb et al. | 28/104 |
| 4,977,016 | 12/1990 | Thornton et al. | 428/225 |
| 4,980,217 | 12/1990 | Grundfest et al. | 428/113 |
| 4,995,151 | 2/1991 | Siegel et al. | 26/69 R |
| 5,010,663 | 4/1991 | Thornton et al. | 38/52 |
| 5,011,183 | 4/1991 | Thornton et al. | 280/743 |
| 5,023,130 | 6/1991 | Simpson et al. | 428/227 |
| 5,030,493 | 7/1991 | Rich | 428/63 |
| 5,033,143 | 7/1991 | Love, III | 8/158 |
| 5,042,722 | 8/1991 | Randall, Jr. | 239/553.5 |
| 5,071,701 | 12/1991 | Tenney et al. | 428/285 |
| 5,073,418 | 12/1991 | Thornton et al. | 428/34.9 |
| 5,080,952 | 1/1992 | Willbanks | 428/91 |
| 5,093,190 | 3/1992 | Kwok et al. | 28/105 |
| 5,098,125 | 3/1992 | Thornton et al. | 280/743 |
| 5,098,764 | 3/1992 | Drelich et al. | 428/131 |
| 5,117,069 | 5/1992 | Higgins, III | 174/261 |
| 5,131,434 | 7/1992 | Krummheuer et al. | 139/35 |
| 5,136,761 | 8/1992 | Sternlieb et al. | 28/104 |
| 5,142,752 | 9/1992 | Greenway et al. | 28/105 |
| 5,142,753 | 9/1992 | Bolliand et al. | 28/167 |
| 5,143,771 | 9/1992 | Fourezon | 428/91 |
| 5,168,006 | 12/1992 | Inoguchi et al. | 428/245 |
| 5,173,360 | 12/1992 | Hiroe et al. | 428/229 |
| 5,180,630 | 1/1993 | Giglia | 428/224 |
| 5,217,796 | 6/1993 | Kasai et al. | 428/229 |
| 5,235,733 | 8/1993 | Willbanks et al. | 28/105 |
| 5,252,386 | 10/1993 | Hughes et al. | 428/224 |
| 5,277,230 | 1/1994 | Sollars, Jr. | 139/389 |
| 5,281,441 | 1/1994 | Kasai et al. | 427/300 |
| 5,292,573 | 3/1994 | Adams, Jr. et al. | 428/196 |
| 5,310,424 | 5/1994 | Taylor | 8/190 |
| 5,311,389 | 5/1994 | Howey | 28/104 |
| 5,320,760 | 6/1994 | Freund et al. | 210/741 |
| 5,320,900 | 6/1994 | Oathout | 28/104 |
| 5,337,460 | 8/1994 | Cockfield et al. | 28/167 |
| 5,350,625 | 9/1994 | Peterson et al. | 428/219 |
| 5,356,680 | 10/1994 | Krummheuer et al. | 428/36.1 |
| 5,397,627 | 3/1995 | Dunbar et al. | 428/229 |
| 5,414,913 | 5/1995 | Hughes | 26/29 P |
| 5,433,987 | 7/1995 | Peterson et al. | 428/137 |
| 5,542,703 | 8/1996 | Beasley | 280/739 |
| 5,554,424 | 9/1996 | Krummheuer et al. | 428/35.2 |
| 5,557,831 | 9/1996 | Kishi et al. | 28/167 |
| 5,566,434 | 10/1996 | Beasley | 28/112 |
| 5,573,841 | 11/1996 | Adam et al. | 28/104 |
| 5,581,856 | 12/1996 | Krummheuer et al. | 26/18.5 |
| 5,593,779 | 1/1997 | Mori et al. | 428/375 |

FOREIGN PATENT DOCUMENTS

| | | |
|---|---|---|
| 59-196243 | of 1984 | Japan . |
| 61-24487 | 2/1986 | Japan . |
| 61-213142 | 9/1986 | Japan . |
| 61-252339 | 11/1986 | Japan . |
| 61-58573 | 12/1986 | Japan . |
| 62-104196 | 5/1987 | Japan . |
| 498047 | 2/1939 | United Kingdom . |
| 2-047-291 | 11/1980 | United Kingdom . |
| WO9534447 | 12/1995 | WIPO . |

OTHER PUBLICATIONS

Courtaulds Fibers Inc., Tencel®, Nature's Luxury Fiber Will Be Experienced By 1.5 Million Plus Readers Through The Pages of Elle, Harper's Bazaar, Allure, Dan's Paper's, (Brochure) (undated).

Courtaulds Fibers Inc., Tencel®, "Technical Overview", (undated).

Ellis, T.L., "Lamination Process", IBM Technical Disclosure, vol. 10, No. 1, p. 12 (Jun. 1967).

"Eco–Comfort", *Playboy Magazine*, Style Section (Jul. 1995) (Courtaulds Fibers Inc. materials).

Givhan, Robin, "Pulp Fabric", *Ann Arbor, MI News* (Mar. 6, 1995) (Courtaulds Fibers Inc. materials).

"If You Hate Breaking Them In", *Good Housekeeping Magazine* (Jul. 1995) (Courtaulds Fibers Inc. materials).

Martino, Anne, "Wood You Wear This?", *Ann Arbor, MI News*, (Mar. 6, 1995) (Courtaulds Fibers Inc. materials).

Milbank, Dana, "Can a New Fiber Take on Rayon", *The Wall Street Journal*, Fashion Section (undated) (Courtaulds Fibers Inc. materials.

Reed, L.J., "Etching of Epoxy Glass Curcuit Board", IBM Technical Disclosure, vol. 6, No. 8, p. 82 (Jan. 1964).

Nemec, Haraid, et al., "Fibrillation of Cellulosic Materials—Can Previous Literature Offer a Solution?", *Lenzinger Berichte*, pp. 69–72 (Sep. 1994).

10
12
14
16
18
20
22
24
26
30
32
34
35
36
38
40
42
44
46
48
50
52
54
56
72
74
76
78
80

FIG. 3
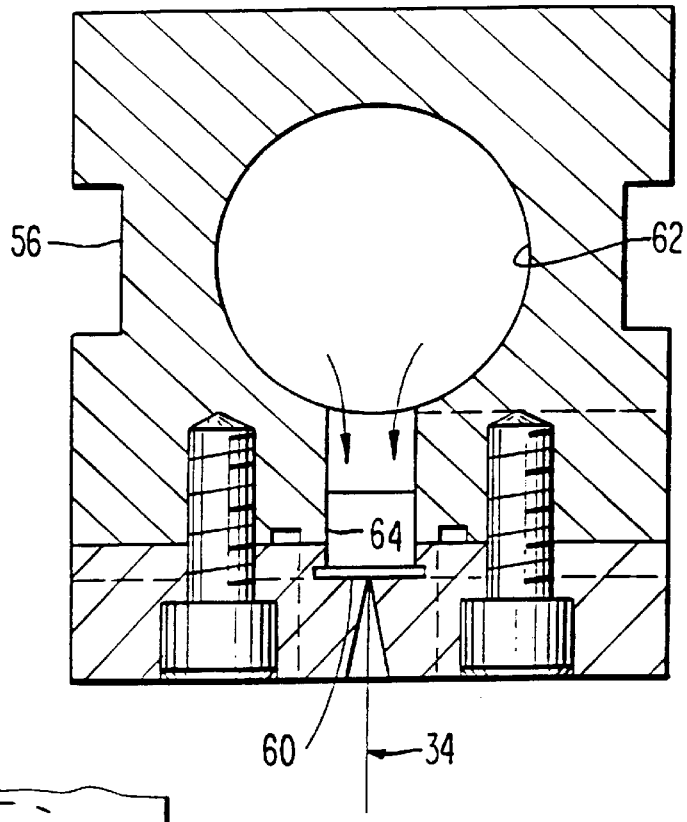
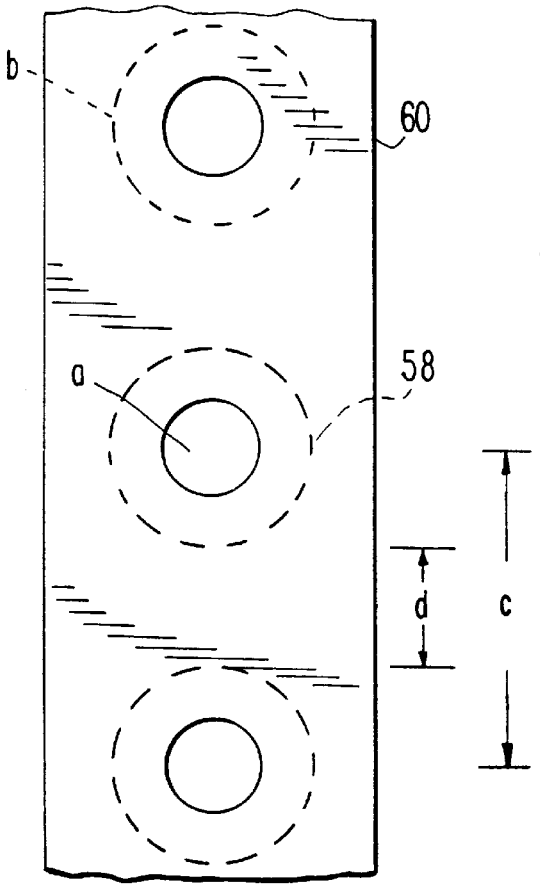
FIG. 4A

226 X

226X

UNIFORMITY AND PRODUCT IMPROVEMENT IN LYOCELL FABRICS WITH HYDRAULIC FLUID TREATMENT

RELATED APPLICATION

This application claims the benefit of U.S. provisional application Ser. No. 60/006,942, filed Nov. 17, 1995.

FIELD OF INVENTION

This invention generally relates to a finishing process for improving the uniformity and physical properties of lyocell and fibrillatable cellulosic based fabrics. More particularly, it is concerned with an hydraulic treatment process which improves fabric properties, and through control and manipulation of lyocell fibers, imparts an aesthetic suede-like finish to the fabric. Fabrics produced by the invention process have improved drape and hand, and wrinkle resistance characteristics.

BACKGROUND ART

Lyocell is a natural cellulosic fiber spun from an amine oxide solvent developed by American ENKA, Asheville, N.C. in the late 1970's. Courtaulds Fibers Inc. of Axis, Ala. ("Courtaulds") markets lyocell fiber under the brand name TENCEL in lengths suitable for short-staple and worsted and woolen spinning systems. TENCEL has a highly crystalline structure and is fabricated from an amine oxide solvent of N-methylmorpholine N-oxide, commonly referred to as NMMO. The industry has found that TENCEL materials are superior to other cellulosics, including cotton and rayon in tensile and aesthetic properties which make it suitable for use in the textile field.

A wide diversity of fabric finishes may be imparted to lyocell fabrics by employing wet processing and enzyme finishing techniques which "fibrillate" the fibers in the fabric. Fibrillation is the formation of micro-fibrils on the surface of fibers as a result of mechanical abrading or splitting of the fiber. It is well known in the textile field that wet processing techniques can be employed to control fibrillation to obtain aesthetic effects.

Courtaulds provides recommended wet processing conditions for finishing TENCEL fabrics. In general, the preferred processing techniques consist of initial wet processing to fibrillate surface fibers in the fabric, an enzyme treatment to remove the surface fibrillation, and a secondary wet processing to fibrillate fibers in the fabric body to provide a "peach skin" or suede fabric finish. Additional recommended processing includes use of scouring techniques, caustic agents and softeners.

Conventional lyocell wet processing techniques have not proven entirely satisfactory because they require long duration washing cycles and controlled enzyme treatments to obtain useful results. It is also found that conventional processing does not consistently yield uniform finishes in lyocell fabrics.

Hydroenhancement techniques have been developed for enhancing the surface finish and texture, durability, and other characteristics of woven or knit spun and spun filament yarn fabric. For example, such techniques are described in commonly owned U.S. Pat. Nos. 4,967,456 and 5,136,761 of H. Sternlieb et al. The hydroenhancing process generally includes exposing one or both surfaces of a fabric to fluid jet treatment, followed by removal of moisture from the fabric and drying. During hydroenhancement, the high pressure water jets impact the spun yarns and cause them to bulk or bloom and the fibers in the yarn to become interentangled. Fabrics produced by this hydraulic treatment process have enhanced surface finish and improved characteristics such as cover, abrasion resistance, drape, stability as well as reduced air permeability, wrinkle recovery, seam slippage and edge fray.

It will be recognized by those skilled in the art that it would be advantageous to provide an hydraulic process for continuous production line finishing of lyocell fabrics. However, it has been the general view in the field that such processing is not suitable for promoting adequate fibrillation in lyocell fabric. For example, Courtaulds, technical manual, *Dyeing and Finishing TENCEL Fabrics in Garment Form*, states that "open width" fabric processes do not fibrillate TENCEL fabrics.

The present invention resides in the discovery that hydraulic treatment, when optimized with respect to specifications of the fluid curtain and process conditions, unexpectedly produces pre-cursor fabrics suitable for further finishing treatment by wet processing techniques. Advantageously, it is found that hydraulic treatment promotes fibrillation in lyocell fabrics and yields a fibrillated fabric finish after wet process treatment. Hydraulic processing in accordance with the invention also yields improvements in fabric properties.

Accordingly, it is a broad object of the present invention to provide an hydraulic treatment finishing process for lyocell fabrics.

A more specific object of the invention is to provide an hydraulic treatment process which uniformly fibrillates and improves physical properties of lyocell fabrics.

A further object of the invention is to provide an hydraulic production line apparatus which is less complex and improved over the prior art.

DISCLOSURE OF THE INVENTION

In the present invention, these purposes, as well as others which will be apparent, are achieved generally by providing an apparatus and related method for hydraulic treatment of lyocell based fabrics through dynamic fluid action. An hydraulic treatment apparatus is employed in the invention in which the fabric is supported on a member and impacted with a uniform, high density jet, fluid curtain under controlled process energies. Hydraulic processing of the invention provides "pre-cursor" fabrics which are characterized by substantial fibrillation of surface and body fibers in the fabric. This hydraulic treatment further promotes uniform fibrillation of the fabric fibers by subsequent wet processing and enzyme finishing techniques. Lyocell fabrics processed employing hydraulic and wet processing techniques of the invention are characterized by a uniform suede-like finish and have superior drape and hand.

According to the preferred method of the invention, the lyocell fabric is advanced on a process line through (i) a scouring station to clean and remove sizing and dirt from the fabric, (ii) a padder for saturation treatment of the fabric with a caustic solution for sufficient duration to weaken bonds in fiber structure to promote fibrillation, (iii) a pre-tentering station to stretch the fabric to a pre-determined excess width to compensate for shrinkage associated with the fluid treatment, (iv) an hydraulic station for fluid treatment of top and bottom surfaces of the fabric, (v) a post-tentering station to stretch the fabric to a desired output width, and (vi) post-washing and enzyme process stations, as required, to provide finished fabric. Tentering treatments are optional and are preferred for lyocell fabrics which have stretch characteristics.

Further advantage may obtained by employing an ultrasonic pre-treatment step in the invention process. It is found that such ultrasonic pre-treatment increases fibrillation of the fabric in subsequent hydraulic and wet process fabric finishing.

Additional post hydraulic processing may include a scouring treatment and use of padding apparatus to apply softening agents to the fabric. It is most preferred to employ softening applications to lyocell fabrics where the hydraulic treatment of the invention are not followed by wet processing treatment.

An apparatus for practicing the invention comprises a continuous line including, scouring, caustic bath, hydraulic treatment, tentering and padder stations which are adapted for continuous fabric processing. Further conventional wet processing stations may be provided for post treatment processing.

The hydraulic treatment stations preferably include a plurality of cross-directionally ("CD") aligned and spaced manifolds in which are mounted fluid jets. An open width support member, which may be porous or non-porous, is provided to support and convey the fabric through the hydraulic stations and production line. A continuous fluid curtain for the process of the invention is provided by a high density spacing of jet nozzles substantially across each of the manifolds. The fluid jets, which are preferably columnar in configuration, are provided by jet nozzles or orifices which have an orifice entrance diameter of 0.0081 to 0.023 cm (0.0032 to 0.009 inches), orifice exit diameter of 0.013 to 0.038 cm (0.0052 to 0.015 inches), inclusive exit angle of 10 to 41 degrees, center-to-center spacing of 0.024 to 0.064 cm (0.0096 to 0.025 inches), and orifice density of 41 to 16 per cm (104 to 40 per inch). This jet configuration provides linear fabric surface coverage of approximately 23 to 25 percent.

Most preferred jet specifications include orifice entrance diameter of 0.013 cm (0.005 inch), exit diameter of 0.0320 cm (0.0126 inch), inclusive exit angle of 41 degrees, center-to-center spacing of 0.041 cm (0.016 inch), orifice density of 24 per cm (61 per inch) and a 21 percent linear fabric surface coverage.

The fluid curtain impacts the fabric with a sufficient energy in the range of $1.2\times10^6$ to $3.5\times10^7$ joule/Kg (0.2 to 6.0 hp-hr/lb), and preferably $2.9\times10^6$ to $1.2\times10^7$ joule/Kg (0.5 to 2.0 hp-hr/lb). It is preferred to employ jet pressures in the range of 3,450 to 20,700 kPa (500 to 3000 psi) and preferably 6,900 to 13,800 kPa (1000 to 2000 psi). The line operates at a speed in the range of 0.0508 to 4.064 m/sec (10 to 800 fpm), and preferably 0.508 to 2.54 m/sec (100 to 500 fpm). At the process energies and line speeds of the invention, the arrangement of densely spaced jets provides a curtain of fluid which yields a uniform fabric finish.

An aspect of the invention is the correlation of energy input to the fabric and support member structure to achieve efficiencies in the hydraulic processing of fabrics. According to a first preferred embodiment of the invention, the support member of the hydraulic line is provided with a porous support member, for example, a woven screen. In this embodiment, it is found that the effectiveness of the hydraulic treatment for fibrillation increases as a function of the energy input to the fabric.

An alternative embodiment of the invention employs a non-porous or solid support member for hydraulic treatment. Most advantageously, the impact of fluid jets against fabric and solid support are found to generate dynamic forces which improve the efficiency of the hydraulic process. In this embodiment, substantial fibrillation is achieved using lower energy treatments with consequent reduction in the requirement for post hydraulic wet processing.

The finishing process of the invention has general application for finishing woven, nonwoven and bonded fabrics of fibrillatable cellulosic fibers and materials including, 100 percent lyocell fibers or blends of lyocell and other fibrous materials. Most preferred results are obtained in fabrics which include staple fiber or yarn constituents.

Other objects, features and advantages of the present invention will be apparent when the detailed description of the preferred embodiments of the invention are considered in conjunction with the drawings which should be construed in an illustrative and not limiting sense as follows:

BRIEF DESCRIPTION OF THE DRAWINGS

FIG. 3 is a cross-sectional view of a manifold employed in an hydraulic treatment module of the invention;

FIGS. 4A–C show top, bottom and side views of jet strip orifice configurations which may be used in the manifold structure of FIG. 3;

BEST MODE OF CARRYING OUT THE INVENTION

The hydraulic apparatus and method of the invention fibrillate lyocell based fabrics by the application of non-compressible fluid under pressure to the fabric, which is carried on a support member. Hydraulic treatment promotes fibrillation in lyocell fabrics which are then finished by further enzyme treatment and wet processing techniques. Lyocell fabrics processed according to the invention have a uniform suede-like finish and improved characteristics in properties, such as cover, drape and hand, and wrinkle resistance. Although the invention has particular application to lyocell fabrics, it will be understood that the principles of the invention have general application to the generic class of fibrillatable cellulosic type fibers and materials. Examples of such fibers include linen, high wet modulus rayon and cupramonium rayon.

Figure 1:
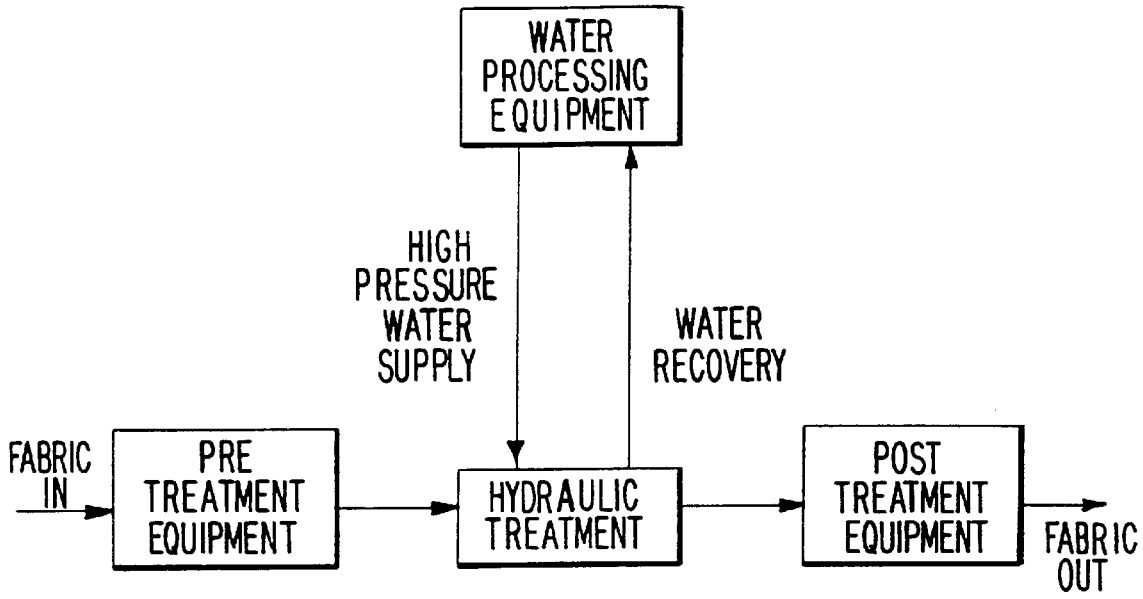
FIG. 1 is a schematic diagram of the process steps for hydraulic finishing fibrillatable cellulosic fabric in accordance with the invention.

With reference to the general process steps of the invention, illustrated in FIG. 1, the fabric is first subjected to required pre-treatment processes, which may include washing to remove dirt and sediments, and scouring to remove fabric sizing. Fibrillation of the fabric may be further promoted by use of a padder or wash stations for saturation treatment with caustic agents such as sodium hydroxide. It is preferred to saturate the fabric in an elevated pH solution, in the range of 9 to 14 pH, at a temperature of 49 to 71° C. (120 to 160 degrees F).

To compensate for shrinkage in the fabric associated with subsequent hydraulic processing, the fabric may also be pre-tentered to stretch it to a shrink compensating excess width.

The pre-treated fabric is then advanced to an hydraulic treatment station in which the fabric is supported on a member and impacted with a continuous curtain of a non-compressible fluid, such as water. Following hydraulic treatment, the fabric is advanced to a post-treatment station and subjected to any required finishing processing which may include, for example, post tentering to obtain a fabric of the desired output width, and padder application of finishing treatments. Tentering treatments are preferred for lyocell fabrics which have stretch characteristics.

Hydraulically processed lyocell fabrics are pre and post-treated by conventional wet process treatments according to techniques recommended by Courtaulds Fibers. Table I sets forth a representative Courtaulds garment wash process which may be employed in the invention. Table II is a Courtaulds listing of chemicals suitable for wet process finishing of TENCEL fabrics. It is preferred in the invention to hydraulically treat TENCEL prior to enzyme and softener applications in the Courtaulds wash sequence.

Further advantage may be obtained by employing an ultrasonic pre-treatment step in the invention process. It is found that such ultrasonic pre-treatment increases fibrillation of the fabric subsequent to hydraulic and wet process fabric finishing.

In accordance with the invention, hydraulic treatment substantially promotes fibrillation in the fabric resulting in process advantage in the finishing of the fabric by wet process techniques. Thus, it is found that hydraulic treatment obtains improved micro-fibril finishes in lyocell fabrics with substantial reductions in conventional wet process requirements.

TABLE I

| TENCEL Wet Processing | |
|---|---|
| 1. | Scour/prefibrillate |
| | 2 g/1 lubricant, e.g., Tebulan UF (Boehme) |
| | 2/g/l Sodium carbonate |
| | 2/g/l detergent, e.g., Zetex HPLFN (Zeneca) |
| | 20 minutes at 60° C. (140° F.) |
| | Tebulan UF is a trademark of Boehme Filatex, Inc., Riedsville, North Carolina 27320. |
| | Zetex HPLFN is a trademark of Zeneca Colours, Charlotte, North Carolina 28273. |
| 2. | Enzyme treatment |
| | 4.5 g/l acid buffer, e.g., Sandacid BS (Sandoz) |

TABLE I-continued

| TENCEL Wet Processing | |
|---|---|
| | 3g/l cellulase enzyme |
| | pH 4.6–4.8 |
| | 60 minutes at 54° C. (130° F.) |
| | Recommended Enzymes: Primafast T 100 (Genencor) |
| | Primafast RFW (Genencor) |
| | Rapidase GL (Gist Brocades) |
| | Biosoft AEX (T S Chemicals) |
| | Sandacid BS is a trademark of Sandoz Chemical Corp., Charlotte, North Carolina 28205. |
| | Rapidase GL is a trademark of GIST Brocades International BV, Charlotte, North Carolina 28224. |
| 3. | Deactivate |
| | Add Sodium carbonate to pH 9–10 |
| | or Raise temperature to 79° C. (175° F.) |
| | Drop and rinse |
| 4. | Soften/secondary fibrillation |
| | 3% softener e.g., Sandoperm MEJ (Sandoz) |
| | 20 minutes at 41° C. (105° F.) |

Courtaulds Fibers Inc., Dyeing and Finishing TENCEL Fabrics in Garment Form (undated).

TABLE II

| Chemicals Suitable for Use in Dye/Wash Processes | |
|---|---|
| Lubricants | |
| Superlube D G | (Stevensons) |
| Alube P 60 | (Achem) |
| Perilan V F | (Dr. Petry) |
| Lyoprep | (TS Chemicals) |
| Nylhydrol P | (Thor) |
| Setavin MO | (Zchimmer & Schwartz) |
| Persoftal LU | (Bayer) |
| Acid Cellulase enzymes | |
| Primafast T100 | (Genencor) |
| Biosoft AEX | (TS Chemicals) |
| Biosoft AEN | (TS Chemicals) |
| Indiage | (Genencor) |
| Liquid Biostone | (TS Chemicals) |
| Liquid Biostone | (Rexodan) |
| Blue J. Stonefree A | (Ivax/Atochem) |
| Rapidase GL | (Gist Brocades) |
| Cellusoft L Plus | (Novo) |
| Rucolase CEL | (Rudolf) |
| Blue J. Stonefree A is a trademark of Ivax Industries, Inc., Rock Hill, South Carolina 29730. | |
| Neutral cellulase enzymes | |
| Biosoft N T P | (TS Chemicals) |
| Blue J Stonefree 1 | (Ivax/Atochem) |
| Buffered Enzymes | |
| Rapidase J | (Gist Brocades) |
| Buffers | |
| Sandacid BS | Citric acid |
| Sodium citrate | Sodium carbonate |
| Sodium bicarbonate | |
| Non-ionic Detergents | |
| Zetex HPLFN | (Zeneca) |
| Densol Plus | (Rexodan) |
| J Boost | (Jeanscare) |
| Lenetol B | (Zeneca) |
| Rucogen OLT | (Rudolf) |
| Softeners | |
| Sandoperm M E J | (Sandoz) |
| Perisoft M V | (Dr Petry) |

TABLE II-continued

| Chemicals Suitable for Use in Dye/Wash Processes | |
|---|---|
| Finistrol F N | (Thor) |
| Perisoft P S W | (Dr Petry) |
| Crosoft TAF NEW | (Crosfield) |
| Sirovelle H M | (P P T) |
| Sirovelle F T | (P P T) |
| Lyosoft | (T S Chemicals) |
| Lyosolk | (T S Chemicals) |

Source: Courtaulds Fibers, Inc. Technical Manual, § 6.3 Chemicals suitable for use in garment dye/wash process (September 1996).

Conventional finishing processes which may be used in the invention include scouring to promote additional fiber fibrillation, enzyme treatment to dissolve and strip excess fibrils, and wet processing to generate fine micro-fibrils in the fabric body. These micro-fibril effects are most prominent in the "knuckles" or cross-over points in the fabric weave. It also is preferred to post-treat lyocell fabrics with softening agents to enhance the fabric finish.

As used herein, wet processing should be understood to mean textile treatments which mechanically abrade and strip fibrils from hydraulically processed "wet out" fabrics of the invention. Wet processing techniques suitable for use in the invention include, among others, beetling, milling, batch washing, garment washing, beck dyeing, jet dyeing and wet rope processing. It should be understood that the requirements for wet processing in the invention are a function of fabric specifications and energy input to the fabric during fluid treatment. In accordance with the invention, hydraulic processing conditions are selected to weaken chemical and mechanical bonds in the fiber structure to promote uniform fibrillation.

In order to obtain "controlled fibrillation" in lyocell fabrics of the invention it is necessary to impact the fabric with a uniform, high density jet, continuous fluid curtain under controlled process energies. The porosity in finished fabrics correlates to energy and pressure process parameters. To obtain demonstrable fibrillation and improvements in fabric properties, the fluid curtain should comprise a dense and uniform array of jets which impact the entire width of the fabric. The fabric must also be impacted with a cumulative process energy in the range of $1.2\times10^6$ to $3.5\times10^7$ joule/Kg (0.2 to 6.0 hp-hr/lb), and preferably $2.9\times10^6$ to $1.2\times10^7$ joule/Kg (0.5 to 2.0 hp-hr/lb). It is preferred to employ jet pressures in the range of 3,450 to 20,700 kPa (500 to 3000 psi) and preferably 6,900 to 13,800 kPa (1000 to 2000 psi). The line operates at a speed in the range of 0.0508 to 4.064 m/sec (10 to 800 fpm), and preferably 0.508 to 2.53 m/s (100 to 500 fpm).

The fluid curtain is preferably formed by jets having a columnar configuration provided by jet nozzles or orifices which have an entrance diameter "a" of 0.0081 to 0.023 cm (0.0032 to 0.009 inches), orifice exit diameter "b" of 0.013 to 0.038 cm (0.0052 to 0.015 inches), inclusive exit angle of 10 to 41 degrees, center-to-center spacing "c" of 0.024 to 0.064 cm (0.0096 to 0.025 inches), and orifice density of 16 to 41 per cm (40 to 104 per inch). See FIGS. 4A–4C. This jet configuration provides linear fabric coverage of approximately 20 to 25 percent.

Most preferred jet specifications include orifice entrance diameter of 0.013 cm (0.005 inch), exit diameter of 0.0320 cm (0.0126 inch), inclusive exit angle of 41 degrees, center-to-center spacing of 0.041 cm (0.016 inch), orifice density of 24 per cm (61 per inch) and a 23 percent linear coverage.

Figure 2:
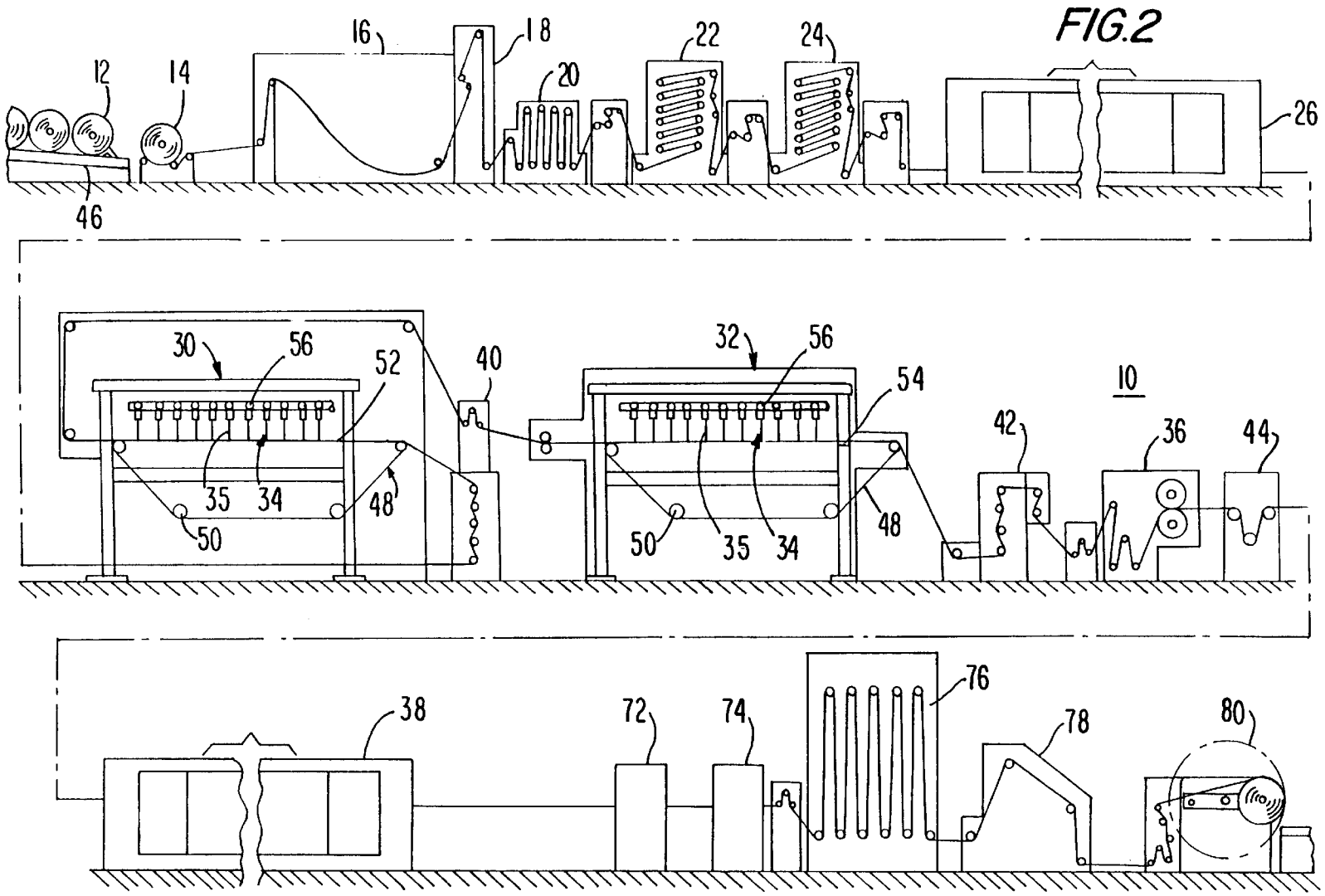
FIG. 2 is a side elevational view illustrating a preferred embodiment of a production line including hydraulic modules for fluid treatment of the cellulosic materials of the invention.

Referring now to FIG. 2, there is illustrated one preferred form of an hydraulic apparatus line of the invention, generally designated 10. The production line includes pre-treatment stations for processing the fabric 12 including, unwind station 14, scray 16, edge guide 18, saturator 20, washer or scouring stations 22, 24, and pre-tenter station 26. Following pre-treatment processing, the fabric is advanced through hydraulic treatment modules 30, 32 which impact the fabric, preferably on both sides, with a fluid curtain 34. Following hydraulic processing, the fabric is advanced to post-treatment stations which may include a padder 36 and tenter frame dryer 38. Further stations which are preferred for use on the line include weft straighteners 40, 42 which are respectively positioned on the line between modules 30, 32 and before padder station 36. A vacuum extractor station 44 may be positioned following the padder station 36. It will be appreciated by those skilled in the art that additional edge guide stations may be employed in the line to center the fabric with the centerline of the apparatus line.

Turning first to the pre-treatment stations of the line, fabric rolls are received in unwind station 14 where the fabric rolls are placed, in succession, on roll feed table 46. In order to provide a continuous processing line capability, the fabric is advanced to a scray apparatus 16 in which the beginning and end sections of successive rolls are joined together by conventional sewing techniques.

From the scray 16, the fabric is advanced to saturator 20 and scouring or washers 22, 24 to clean the fabric prior to hydraulic treatment and, if required, to remove sizing and tint which are generally used in the weaving of fabrics. The saturator and washing apparatus are preferably provided with regulated temperature controls and scouring water temperatures of up to 91° C. (195 degrees Fahrenheit). The saturator and washers may also be employed for caustic treatment of the lyocell fabric.

Following the scouring treatment, the fabric is pre-tentered (stretched) at pre-tenter station 26 to a predetermined width in excess of a desired finished width of the fabric. The pre-tentering width is selected so that the expected shrinkage caused by the hydraulic treatment process reduces the width of the finished fabric to slightly less than the desired finished width. The post-tenter or tenter frame dryer 38 is used to post-tenter the fabric after hydraulic processing only by a slight amount to the exact desired finished width. At padder station 36 softening agents may be applied to the hydraulically treated fabric.

The preferred process line 10 of the invention includes two in-line hydraulic treatment modules 30, 32. As shown in FIG. 2, the fabric is first fluid treated on one side in module 30 and then advanced to module 32 for treatment of its reverse side. Each module 30, 32 includes an endless conveyor 48 driven by rollers 50 and tensioning guide mechanisms (not shown) which advance the fabric in a machine direction on the line. The conveyor 48 in each module presents a generally planar support member, respectively designated 52, 54 in modules 30, 32, for the fabric in the hydraulic treatment zone of the module.

The support members 52, 54 preferably have a substantially flat configuration, and may be solid or include fluid pervious open areas (not shown). According to a preferred embodiment, support members 52, 54 for use in the invention are a plain mesh weave screen, for example, a conventional mesh stainless steel or plain weave screen formed of polyester warp and shute round filament. As described more fully below, the fabric is supported in contact with the screen while open areas drain away water applied to the fabric. In this embodiment, the open areas occupy approximately 12 to 40 percent of the screen.

An alternative support member structure for use in the invention is disclosed in commonly owned U.S. Pat. No. 5,142,752 of Greenway et al. which is incorporated herein by reference. This patent discloses a porous screen, shown in FIGS. 4C and D, in which apertures are defined by curved radial portions.

As will be described more fully below, similar advantages may be obtained by use of solid support members as well as members formed of fine mesh screens which have a variety of contoured weave patterns, for example, a twill weave.

Each module 30, 32 includes an arrangement of parallel and spaced manifolds 56 oriented in a cross-direction ("CD") relative to movement of the fabric 12. The manifolds, which are spaced approximately 20.3 cm (8 inches) apart, each include a plurality of closely aligned and spaced columnar jet orifices 58 (shown in FIG. 4A) which are spaced approximately 1.27 to 2.45 cms (0.5 to 1 inches) from the support members 52, 54. A preferred manifold structure employs a jet strip 60 which is provided with precisely calibrated jet orifices which define the jet array.

Figure 5:
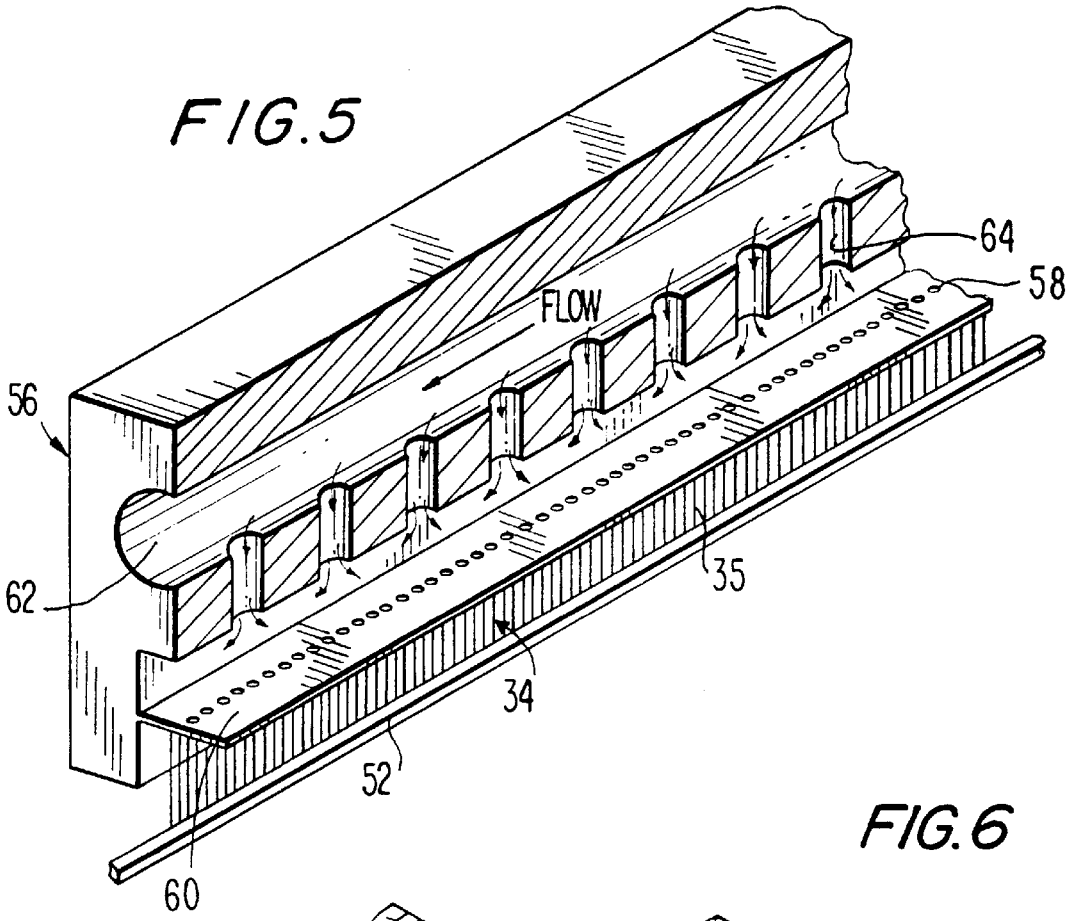
FIG. 5 is a partial isometric view of the manifold of FIG. 3 showing a jet strip structure and columnar fluid curtain employed in the invention.

FIG. 3 shows a cross-section of a preferred manifold structure for use in the invention. High pressure is directed through the main plenum 62 to distribution holes 64. As best shown in FIG. 5, the jet strips 60 are mounted in the manifold to provide dynamic fluid source for the jet strips. The jet orifices 58 preferably have entrance diameters "a" in the range of 0.0081 to 0.023 cm (0.0032 to 0.009 inches), and center-to-center spacing "c" of 0.024 to 0.064 cm (0.0096 to 0.025 inches), respectively, and are designed to impact the fabric with fluid pressures in the range of 3,450 to 20,700 kPa (500 to 3000 psi).

Figure 4B:
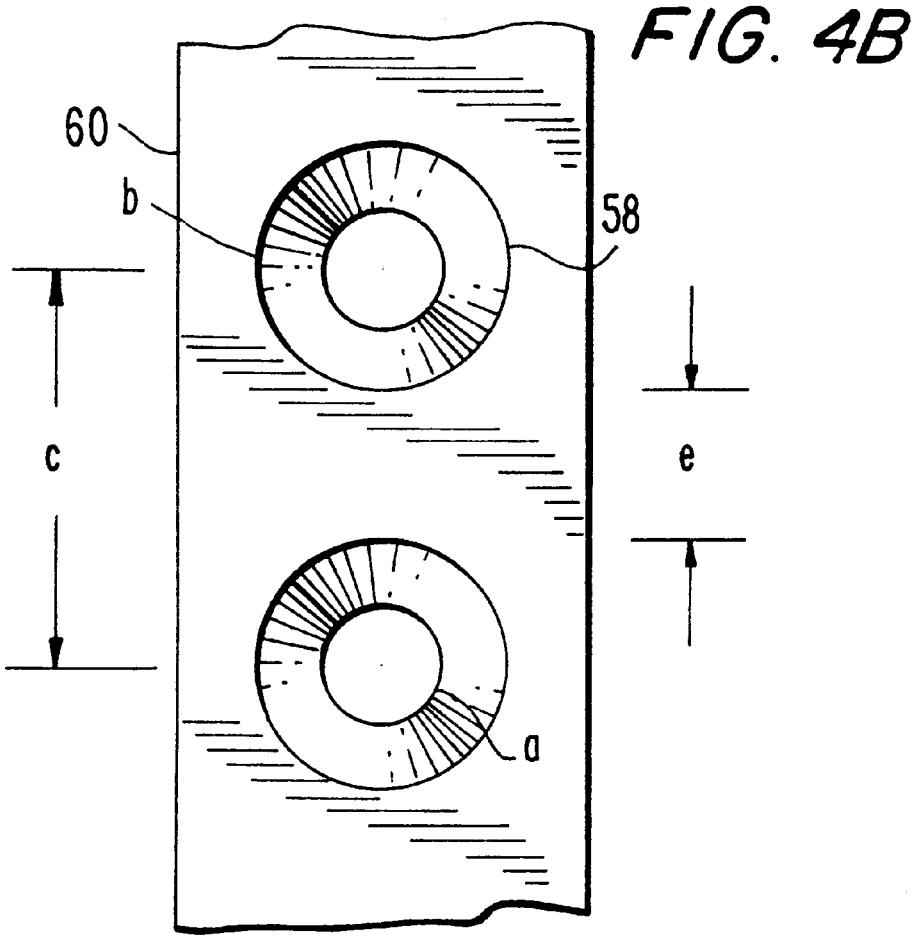
Figure 4C:
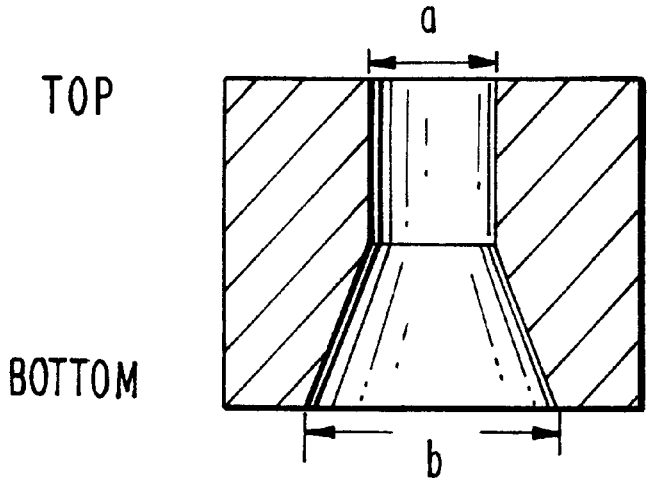

FIGS. 4A–C show a preferred jet strip 60 which includes a dense linear array of jet orifices 58. It is believed that advantage is obtained by employing a uniform and extremely dense array of jets. A preferred jet strip is provided with a jet density in the approximate range of 16 to 41 orifices per cm (40 to 104 orifices per inch), and most preferably, 24 orifices per cm (61 orifices per inch). The spacing between each jet orifice 58 at the entrance "d" is 0.028 cm (0.011 inches) and the spacing at the exit "e" is 0.010 cm (0.004 inches).

Figure 4D:
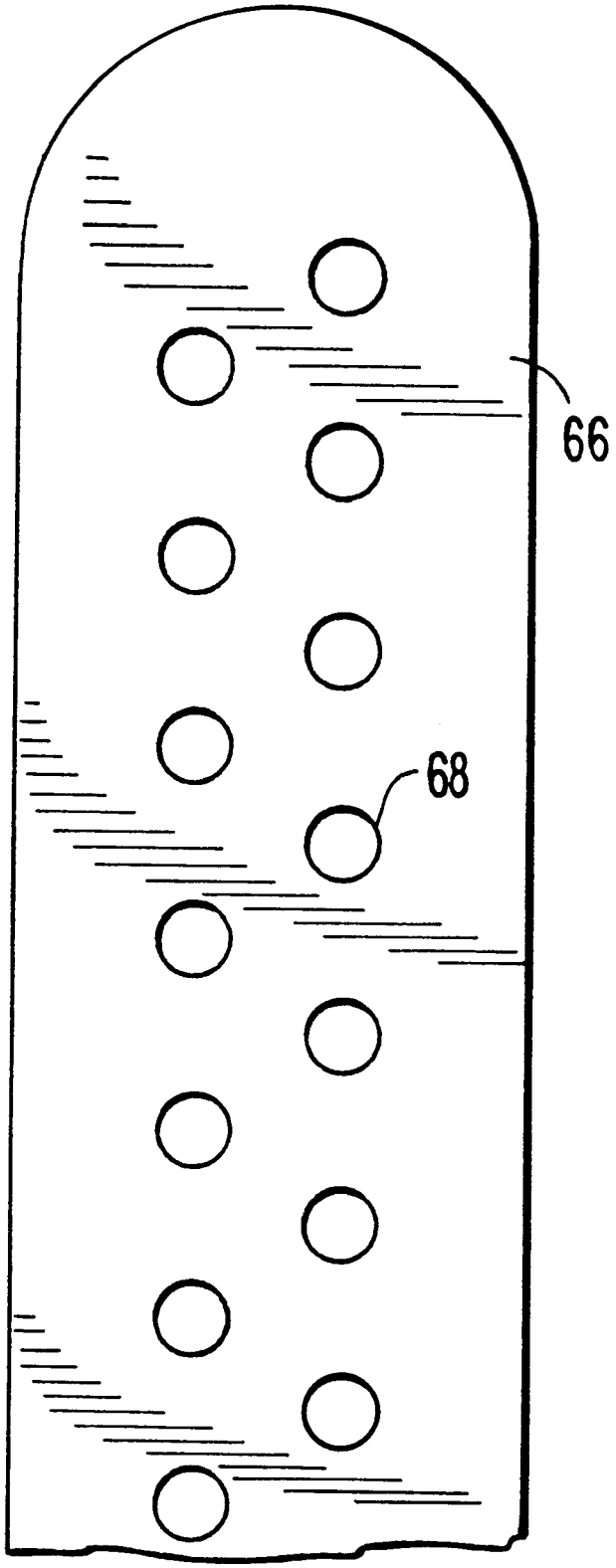
FIG. 4D is an alternative staggered double jet orifice arrangement for use in the manifold of FIG. 3.

FIG. 4D shows an alternative jet strip 66 which includes staggered linear arrays of jet orifices 68. This staggered arrangement obtains an increased jet orifice density of approximately 31 to 82 orifices per cm (80 to 208 orifices per inch).

Energy input to the fabric is cumulative along the line and preferably set at approximately the same level in modules 30, 32 to impart uniform hydraulic treatment to the fabric. Within each module, advantage may be obtained by ramping or varying the energy levels from manifold to manifold. According to the invention, the fluid curtain 34 is uniform and continuous in the cross direction of the line. As will be more fully described hereinafter, the continuous fluid curtain preferably comprises a dense array of columnar fluid jets 35. Energy specifications for the fluid curtains are selected to correlate with desired end physical properties in the finished fabric.

In the hydraulic modules, the fabric is preferably impacted with uniform fluid on both top and bottom sides. Energy requirements for effective fabric finish vary as a function of fabric type, composition, weave, and weight. Accordingly, it is necessary to employ a cumulative process energy which is sufficient for a select fabric work piece to achieve uniform fibrillation within the fabric. Demonstrable fibrillation and improvements in physical properties are obtained in the invention within the energy range of $1.2\times10^6$ to $3.5\times10^7$ joule/Kg (0.2 to 6.0 hp-hr/lb).

Figure 6:
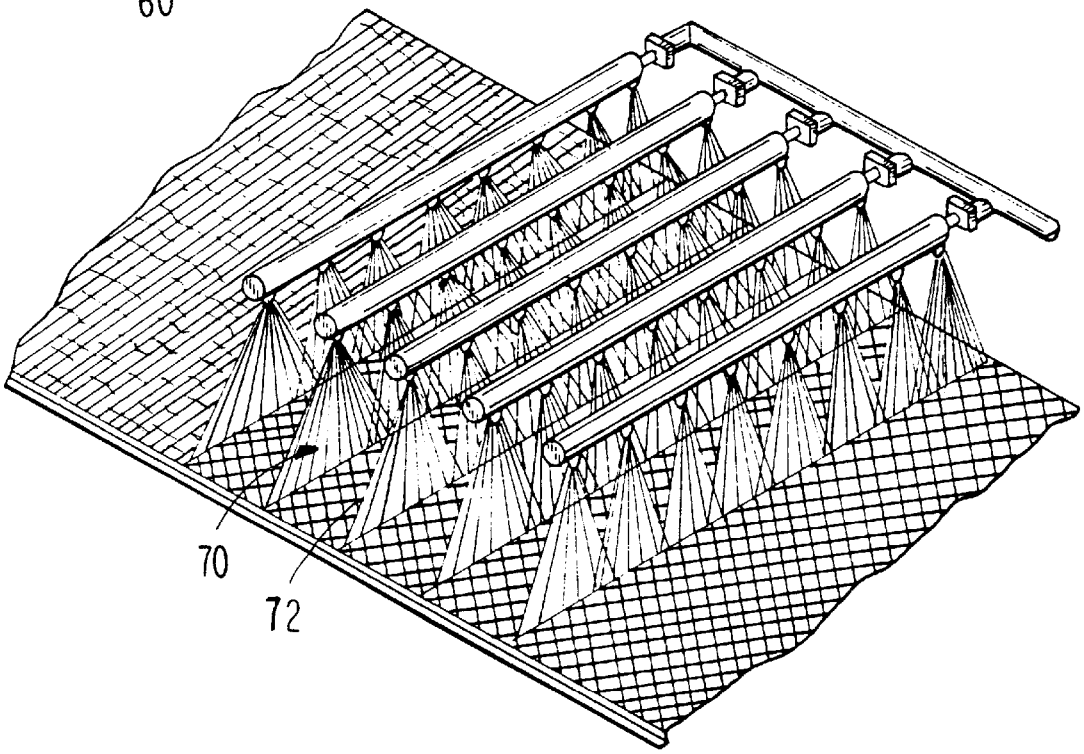
FIG. 6 is a perspective view of an alternative manifold arrangement of the invention including a fluid curtain formed by overlapping fan jets.

A preferred schematic of the fluid curtain is best shown in FIG. 5 wherein columnar jets 35 are shown in dense array positioned in the cross-direction of production line 10. The columnar jets in the curtain have a general perpendicular orientation to a support member. FIG. 6 shows an alternative fluid curtain 70 including divergent or angled fluid jets 72. This arrangement provides a tentering effect in the hydraulic process to stabilize the fabric matrix.

Following hydraulic treatment the fabric may be advanced for post-treatment through the weft straightener 42, padder 36, vacuum extractor 44, and tenter frame dryer station 38. For example, at padder station 36 conventional softeners, resins and finishing treatments may be applied to the fabric 12.

Following tenter drying, the fabric 12 is advanced to inspection stations which may include, a weft detector to sense fabric straightness, moisture detectors and optical equipment to monitor the fabric for possible defects. FIG. 2 also shows a fabric accumulator 76, operator inspection station 78 and fabric wind-up station 80.

Figure 10:
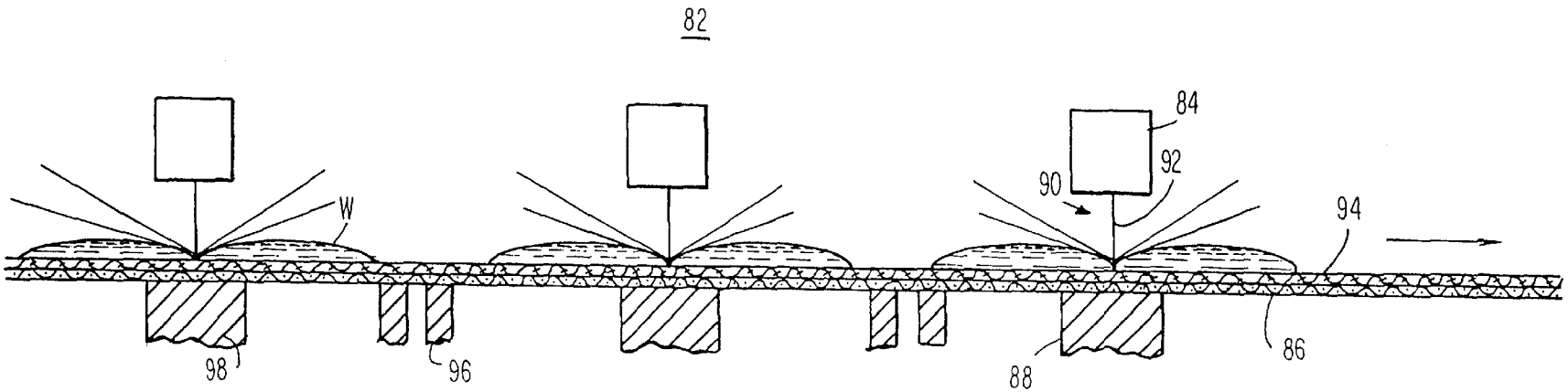
FIG. 10 is a schematic view of the production line of FIG. 2 wherein solid support surfaces are provided in the hydraulic modules.

An alternative embodiment of the invention, employs a non-porous or solid support member for hydraulic fabric treatment. FIG. 10 is a schematic view of the production line of FIG. 2 showing an exploded view of an hydraulic module 82 including a series of manifolds 84 disposed over a finely woven conveyor belt 86. A continuous fluid curtain 90 is provided by densely packed columnar jets 92 which impact a fabric 94 on conveyor. Vacuum slots 96 are disposed on line for drainage of fluid from the hydraulic module. According to the invention, solid support members 98, which may comprise stainless steel sheets, are positioned under the conveyor belt 86 in the areas of fluid curtain fabric impact. It is found that the impact of fluid jets against the fabric and solid support members improves the efficiency of the hydraulic process. In this embodiment, substantial fibrillation is achieved using lower energy treatments with consequent reduction in the requirement for post hydraulic wet processing.

The mechanism by which such efficiencies are obtained with solid support surfaces is not fully understood. As shown in the FIG. 10 schematic drawing, use of the solid supports 98 causes formation of pools of water "W" in the fluid impact areas of the hydraulic module. It would be expected that pooling of water should reduce the impact of the jets and absorb energy, thereby reducing the efficiency of the hydraulic treatment. Most surprisingly, the solid supports arrangement of this embodiment improves the efficiency of the hydraulic process and achieves a substantial fibrillation at reduced energy levels.

It is believed that improved energy efficiencies obtained through use of solid supports may result from a cavitation effect in the water pool formed in the hydrualic impact areas. Another theory for this energy effect is that pressure waves generated by impact of the jets in water pools contribute to splitting of fibrillatable fibers in the fabric.

Those skilled in the art will appreciate that various techniques are known for providing solid screen fluid treatment. For example, as an alternative to the arrangement of FIG. 10, a solid roll may be used to transport the fabric under a fluid curtain.

Figure 11:
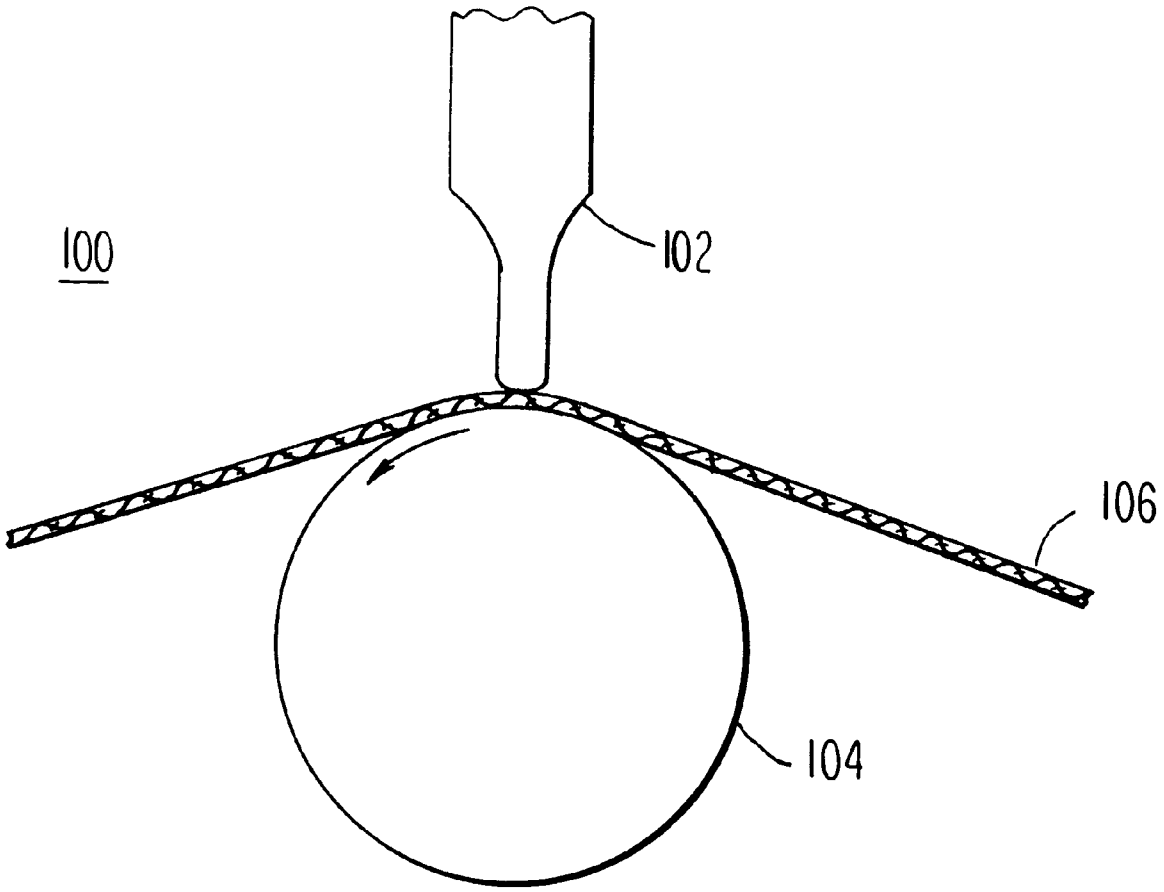
FIG. 11 is a schematic view of a pre-treatment ultrasonic station which may be employed in the production lines of FIGS. 2 and 10.

FIG. 11 is a schematic view of a pre-treatment ultrasonic station 100 which may be employed in the production lines of FIGS. 2 and 10. Station 100 includes a conventional ultrasonic horn 102, and a solid anvil roll 104 which coacts with the horn and conveys a fabric 106 through the station. It should be understood that ultrasonic treatment may be used in combination with the hydraulic and pre- and post-fabric treatments of the invention.

It has been found that ultrasonic pre-treatment increases the level of fibrillation achieved in subsequent hydraulic processing of fibrillatable cellulosic fabrics. In addition, where wet processing is employed in the production line to finish lyocell fabric, ultrasonic pre-treatment substantially reduces the time and energy required to fibrillate and finish fabrics by hydraulic and wet process techniques. Similarly, ultrasonic pre-treatment may be used in combination with conventional wet processing techniques without requirement of the invention hydraulic treatment to reduce wet process time requirements.

In a preferred embodiment of the invention process line, ultrasonic and caustic pre-treatments are employed in combination with hydraulic treatment. The following are representative of ultrasonic process conditions found suitable for use in the invention: 100% amplitude, 0.25 m/sec (50 ft/min) line speed, 414 kPa (60 psi) horn pressure, smooth steel roll anvil, and fabric processed face up.

An advance in the present invention resides in providing an hydraulic treatment process which obtains a substantially uniform micro-fibril finish in lyocell fabrics. For example, in a conventional woven lyocell fabric, fibers or yarns are interlaced at crossover areas to define interstitial open areas, surface fibers, and body fibers within the fabric. The open width hydraulic treatment of the invention uniformly acts upon and fibrillates both surface and body fibers in the fabric. It is believed that conventional wet processes are inadequate to obtain the uniform finishes of the invention.

Thus, the invention correlates fibrillation fabric characteristics to energy and pressure process parameters, as well as to wet processing techniques, to uniformly treat surface and body fibers in the fabric. Hydraulic processing of the invention weakens chemical and mechanical bonds in the fiber structure to promote fibrillation. Most advantageously, it is found that hydraulic treatment promotes process efficiencies in subsequent wet process and textile finishing of the fabric.

Finally, it is found that various physical properties of lyocell fabrics are obtained as an adjunct to stabilizing the fabric weave. In particular, fluid treated fabrics of the invention demonstrate substantial improvement in at least two of uniformity, hand and drape, cover, opacity, increased or decreased bulk, increased or decreased air permeability, abrasion resistance, edge fray, and seam slippage.

Prior art hydraulic techniques having application to upgrade the quality of spun yarn fabrics are disclosed in commonly owned U.S. Pat. Nos. 4,967,456 and 5,136,761 of H. Sternlieb et al., which are incorporated herein by reference. According to the teachings of this art, high pressure water jets impact upon the spun yarns and cause them to bulk or bloom and interentangle fiber ends in the spun yarn.

As representative of the scope of the invention, Examples are set forth below to illustrate pre-selected improvements in the physical properties in fabric work pieces. For the Examples, a prototype line was employed which simulated the two stage hydraulic modules of the invention. Prior to hydraulic processing, fabrics of the Examples were scoured to clean and remove sizing from the fabric. Following hydraulic treatment, the fabrics were processed in a heat set tenter to impart a uniform width to the fabric. It will be recognized that further advantage, for fabrics having stretch characteristics, would be obtained in the Examples with the addition of the pre-tenter processing of the invention.

As in the line of FIG. 2, two hydraulic modules were employed for treatment of top and bottom sides of the fabric. Within each module, manifolds 56 were spaced approximately 20.3 cm (8 inches) apart and provided with densely packed columnar jets. The fabric was processed on a 100×94 weave stainless steel screen having a 28% open area. Manifolds used in this example were provided with orifice strips having 0.013 cm (0.005 inch) diameter holes at a frequency of 24 holes per cm (61 holes per inch). Specifications of the fluid curtain were varied in the Examples to obtain specified energy levels and illustrate the range of properties which can be altered in the invention process.

Examples 1–4 set forth data for fabrics hydraulically treated in accordance with the invention on the test process line. Standard testing procedures of The American Society for Testing and Materials (ASTM) were employed to test the characteristics of the control and processed fabrics.

EXAMPLE 1

Achieve Fibrillation Which is Visible After Fluid Treatment, Increase Bulk, Improve Edge Fraying During Washing A 100% Tencel, 136 g/m$^2$ (4 ounce per square yard) fabric was hydraulically processed in accordance with the invention employing the prototype line. Manifold pressure was set at 12,100 kPa (1750 psi) and a line speed of 0.25 m/s (50 feet per minute). The fabric sample was passed under 15 manifolds on each of its sides and impacted with a cumulative energy of $2.9\times10^7$ joule/Kg (5.0 hp-hr/lb) of fabric.

The fluid treated fabric was then washed and dried as follows: Three cycles in a home washing machine, at 12 minutes in length each, using 52° C. (125 degree F) water, with 45 grams of TIDE detergent. Total fabric weight in wash load of 1.8 kg (4 pounds). Fabrics dried in a home dryer, on cotton/sturdy cycle for ½ hour and removed immediately upon end of cycle.

Table III sets forth physical property data for control and fluid treated (unwashed) fabric samples:

TABLE III

| Fabric Sample | Control | Fluid Treated (unwashed) |
|---|---|---|
| Weight g/m$^2$ (osy) | 129 (3.79) | 169 (4.99) |
| Bulk mm (mils) | .295 (11.6) | .574 (22.6) |
| Air Perm. cm$^3$/cm$^2$/s (cfm) | 124 (244) | 8.43 (16.6) |
| Warp Tear Strength kg (lb.) | 3.64 (8.02) | .730 (1.61) |
| Weft Tear Strength kg (lb.) | 2.88 (6.35) | .617 (1.36) |
| Warp Strength kg (lb.) | 31.6 (69.6) | 14.5 (32) |
| Percent Fraying (%) | 2.09 | 0.49 |

Figure 7A:
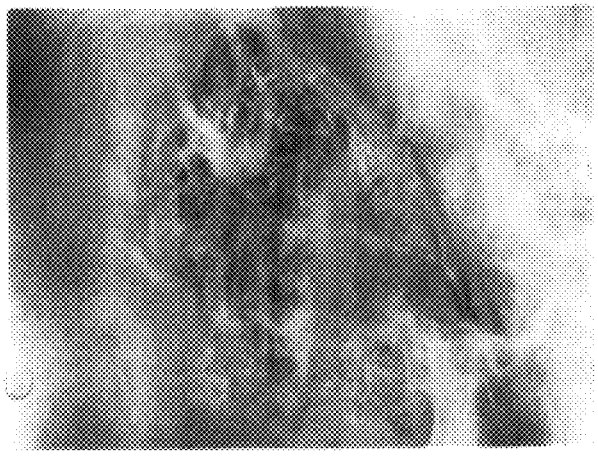
FIGS. 7A and B are photomicrographs at 226× magnification of a hydraulically pre-cursor and wet processed lyocell fabric in accordance with Example 1.
Figure 7B:
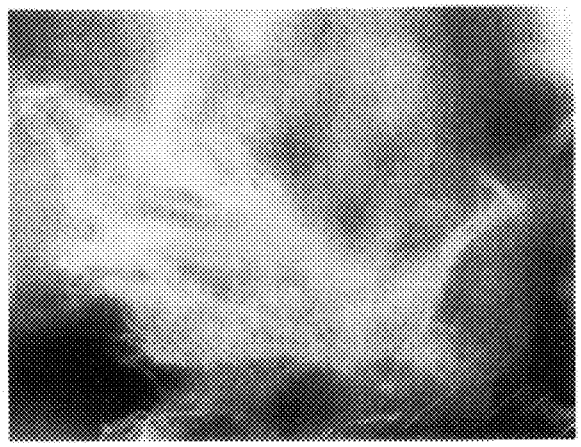

Following fluid treatment, as shown in FIG. 7A, the fabric exhibited substantial surface fiber fibrillation. As shown in FIG. 7B, subsequent wet washings resulted in a uniform micro-fibril finish in the fabric.

EXAMPLE 2

Achieve "Pre-Cursor" Fabrics Which Fibrillate Readily During Post Wet Washing, Increase Bulk, improve Edge Fraying During Washing A 100% Tencel, 136 g/m$^2$ (4 ounce per square yard) fabric was hydraulically processed on the prototype line in accordance with the invention. Manifold pressure was set at 6,900 kPa (1000 psi) and a line speed of 0.25 m/s (50 feet per minute). The fabric sample was passed under 9 manifolds on each of its sides and impacted with a cumulative energy level of $7.9\times10^6$ joule/Kg (1.4 hp-hr/lb) of fabric.

Following fluid treatment, the fabric sample was washed in accordance with the procedures set forth in Example 1. Table IV sets forth physical property data for control and fluid treated (unwashed) fabric samples:

TABLE IV

| Fabric Sample | Control | Fluid Treated (unwashed) |
|---|---|---|
| Weight g/m$^2$ (osy) | 129 (3.79) | 161 (4.74) |
| Bulk mm (mils) | .295 (11.6) | .503 (19.8) |
| Air Perm. cm$^3$/cm$^2$/s (cfm) | 124 (244) | 24.3 (47.9) |
| Warp Tear Strength kg (lb.) | 3.64 (8.02) | 1.42 (3.13) |
| Weft Tear Strength kg (lb.) | 2.88 (6.35) | 1.01 (2.23) |
| Warp Strength kg (lb.) | 31.6 (69.6) | 27.2 (59.9) |
| Percent Fraying (%) | 2.09 | 1.85 |

Figure 8A:
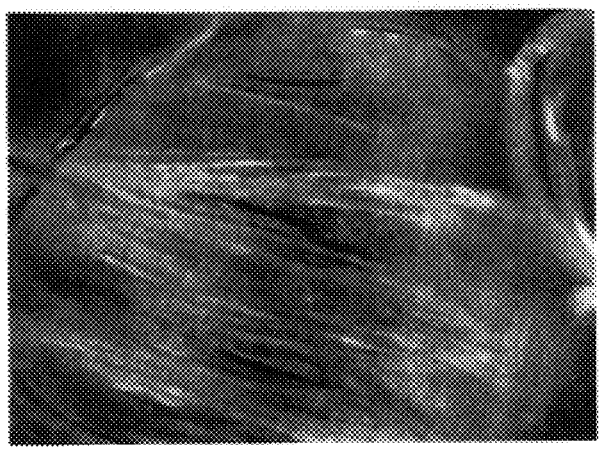
FIGS. 8A and B are photomicrographs at 226× magnification of hydraulically pre-cursor and wet processed lyocell fabric in accordance with Example 2.
Figure 8B:
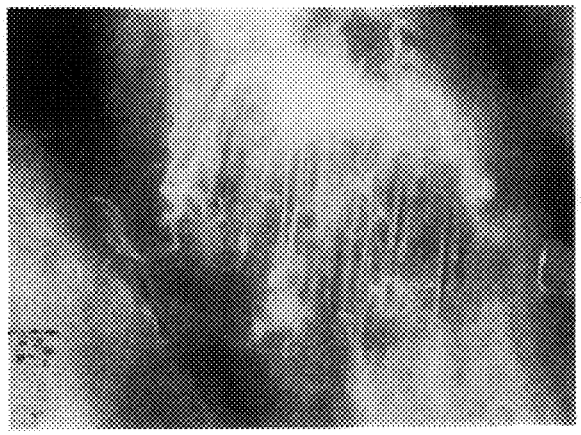

After fluid treatment, as shown in FIG. 8A, surface fibers have visible stress fractures after fluid treatment. Subsequent wet washings resulted in increased uniform fibrillation. See FIG. 8B.

EXAMPLE 3

Little Affect on Fibrillation, Improve Bulk

A 100% Tencel, 136 g/m$^2$ (4 ounce per square yard) fabric was processed on the prototype line in accordance with the invention. Manifold pressure was set at 1,720 kPa (250 psi) and a line speed of 0.25 m/s (50 feet per minute). The fabric sample was passed under 3 manifolds on each of its sides and impacted with a cumulative energy of $5.9\times10^5$ joule/Kg (0.1 hp-hr/lb.) of fabric. Thereafter, the fabric sample was washed in accordance with the procedures set forth in Example 1. Table V sets forth physical property data for control and fluid treated (unwashed) fabric samples:

TABLE V

| Fabric Sample | Control | Fluid Treated (unwashed) |
|---|---|---|
| Weight g/m$^2$ (osy) | 129 (3.79) | 135 (3.99) |
| Bulk mm (mils) | .295 (11.6) | .345 (13.6) |
| Air Perm. cm$^3$/cm$^2$/s (cfm) | 124 (244) | 84.94 (167.2) |
| Warp Tear Strength kg (lb.) | 3.64 (8.02) | 3.34 (7.37) |
| Weft Tear Strength kg (lb.) | 2.88 (6.35) | 2.82 (6.21) |
| Warp Strength kg (lb.) | 31.6 (69.6) | 29.8 (65.7) |
| Percent Fraying (%) | 2.09 | 2.09 |

Fluid treatment at the reduced energy level of this Example yielded limited surface fiber damage or stress fractures. See FIG. 9A. Subsequent wet washings of fabric, shown in FIG. 9B, achieved modest fiber fibrillation.

EXAMPLE 4

Fibrillation of High Wet Modulus Rayon Fabric, Improvement in Fabric Drape and Hand A 3.57 osy plain weave print cloth and 6.17 osy twill print base fabrics made of 100 percent high wet modulus rayon fibers were hydraulically treated on the prototype line. Manifold pressure was set at 12,100 kPa (1750 psi), and fabrics were processed at $2.9\times10^6$ joule/kg (0.5 hp-hr/lb) and $11.5\times10^6$ joule/kg (2.0 hp-hr/lb) energy levels. The fabric samples were passed under a number of manifolds on each of its sides and line speeds were adjusted to obtain specified cumulative energy input to the fabric. Thereafter, the fabric samples were washed in accordance with the procedures set is forth in Example 1. Tables VIA and B set forth physical property data for control and fluid treated (unwashed) fabric samples.

TABLE VIA

| | Fabric Sample - Print Cloth/Plain Weave | | |
|---|---|---|---|
| | Control | $2.9\times10^6$ joule/kg (0.5 hp – hr/lb) 12 Manifolds, 1.02 m/sec (200 ft/min) | $11.5\times10^6$ joule/kg (2.0 hp – hr/lb) 12 Manifolds, .25 m/sec (50 ft/min) |
| Weight g/m$^2$ (osy) | 121 (3.57) | 151 (4.44) | 157 (4.62) |
| Thickness (Thousandths) cm (in) | 31.2 (12.3) | 62.5 (24.6) | 66.5 (26.2) |
| Air Permeability cm$^3$/sec (cubic ft/min) | $1.345\times10^5$ (285.0) | $3.634\times10^4$ (77.0) | $3.318\times10^4$ (77.3) |
| Tear Strength (grams) | 1331 × 1318 | 858 × 1024 | 784 × 755 |

TABLE VIB

| | Fabric Sample - Print Base | | |
|---|---|---|---|
| | Control | $2.9 \times 10^6$ joule/kg (0.5 hp – hr/lb) 6 Manifolds, .50 m/sec (100 ft/min) | $11.5 \times 10^6$ joule/kg (2.0 hp – hr/lb) 12 Manifolds, .50 m/sec (100 ft/min) |
| Weight g/m$^2$ (osy) | 209 (6.17) | 248 (7.3) | 258 (7.6) |
| Thickness (Thousandths) cm (in) | 50.8 (20.0) | 83.1 (32.7) | 94.2 (37.1) |
| Air Permeability cm$^3$/sec (cubic ft/min) | $2.595 \times 10^4$ (54.97) | $1.395 \times 10^4$ (29.55) | $1.458 \times 10^4$ (30.9) |
| Tear Strength (grams) | 3021 × 1818 | 1856 × 934 | 1472 × 883 |

Hydraulic fluid treatment of the high modulus rayon fabrics of this Example, in combination with wet processing, yielded fabric finishes with substantially improved drape, and a fibrillated peach skin-like surface. It was observed that superior fibrillation results were obtained at higher energy levels.

In the foregoing Examples, the hydraulic treatment process of the invention is shown to yield an improved uniform micro-fibril finish in fibrillatable cellulosic fiber fabrics. It should be understood that further advantage would be obtained in the foregoing Examples through use of the additional pre- and post-processing techniques of the invention, for example, pre-caustic treatment and enzyme stripping of surface fibrils in unfinished fabrics.

The invention process also obtains improvements in fabric properties including, cover, hand and drape, opacity, increased or decreased bulk, increased or decreased air permeability, abrasion resistance, edge fray, and seam slippage.

Thus, the invention provides a method and apparatus for finishing lyocell materials by application of a continuous non-compressible fluid curtain against support screens. A wide range of fabric properties can be upgraded or obtained for desired fabric applications. The hydraulic treatment technique of the invention upgrades the fabric by uniformly fibrillating lyocell. Further, pre-and post treatment processes may also be employed, for example, soft and caustic scouring to remove oil, sizing and dirt. Pre-Tentering and post-heat set tentering may be used to stretch, shrink and heat set the fabric.

It should be understood that the principles of the invention have general application to all types of woven and non-woven lyocell and fibrillatable cellulosic fabrics including, spun yarn, spun/filament and 100 percent filament yarns.

Other modes of hydroprocess treatment may be devised in accordance with principles of the invention. Thus, although the invention employs two hydraulic modules in the process line, additional modules are within the scope of the invention. Advantage would also be obtained by provision of a pre-treatment hydraulic module for opening fabric yarns prior to pre-tentering. See FIG. 2. Similarly, although, columnar jets are preferred for use in the invention fluid curtain, other jet types are within the scope of the invention. For example, advantage may be obtained by use of a fluid curtain which includes divergent or fan jets. Hydraulic fluid treatment systems which include divergent jets are described in commonly owned U.S. Pat. Nos. 4,960,630 and 4,995,151 which are incorporated herein by reference.

It should also be understood that pre-treatment caustic, ultrasonic and other processes of the invention will provide advantage when employed in combination with conventional wet processing without requirement of hydraulic treatment.

In the apparatus of the present invention, a fluid curtain comprising divergent jets can be provided by inverting the jet strip 60 in manifold structure 56. See FIG. 3. Fluid jets in the inverted jet strip have an angle of divergence defined by the differential in the entrance and exit diameters of the jet orifices.

Divergent jet systems are advantageous insofar as angled fluid streams, which overlap, effect a uniform processing of the fabric. Where divergent jets are employed, it is preferred that the jets have an angle of divergence of approximately 2–45 degrees and spacing from the support screen of 2.54 to 25.4 cm (1 to 10 inches) to define an overlapping jet array. Experimentation has shown that a divergence angle of about 18 degrees yields an optimum fan shape and an even curtain of water pressure.

Similarly, although the preferred line employs support members or screens which have a generally planar configuration, it will be appreciated that contoured support members and/or drum support modules may be used in the invention.

Other variations of structures, materials, products and processes may of course be devised. All such variations, additions, and modifications are nevertheless considered to be within the spirit and scope of the present invention, as defined in the claims appended hereto.

We claim:

1. A method for finishing textile fabric including fibrillatable cellulosic fibers, the method comprising the steps of:

supporting the fabric on an open width support member, and uniformly and continuously impacting at least one side of the fabric with a continuous curtain of fluid with a sufficient energy to fibrillate fibers in the fabric.

2. A method according to claim 1, comprising the further step of applying an enzyme to the fabric.

3. A method according to claim 1, comprising the further step of scouring the fabric.

4. A method according to claim 1, wherein the support member is porous.

5. A method according to claim 1, wherein the support member is non-porous.

6. A method according to claim 1, comprising the further step of wet processing the fabric.

7. A method according to claim 1, comprising the further step of saturating the fabric with a caustic solution.

8. A method according to claim 1, comprising the further step of ultrasonically treating the fabric.

9. A method according to claim 7, wherein the caustic solution has a pH in the range of 9 to 15, and temperature of 49 to 71° C. (120 to 160° F.).

10. A method according to claim 1, comprising the further step of heat tentering the fabric subsequent to fluid treatment.

11. A method according to claim 1, comprising the further step of applying a softening agent to the fabric subsequent to fluid treatment.

12. A method according to claim 1, wherein the fabric includes lyocell fiber.

13. A method according to claim 1, comprising the further steps of: saturating the fabric with a caustic solution prior to fluid treatment, and applying an enzyme to the fabric subsequent to fluid treatment to dissolve and strip excess fibrils in the fabric.

14. A method according to claim 13, comprising the further step of wet processing the fabric subsequent to fluid treatment to fibrillate and impart a suede-like finish to the fabric.

15. A method according to claim 13, comprising the further step of scouring the fabric prior to the fluid treatment step to clean and remove sizing from the fabric.

16. A method according to claim 14, wherein the wet processing step includes jet dyeing.

17. A method according to claim 14, wherein the wet processing step includes washing.

18. A method according to claim 14, wherein the fabric includes fibers selected from the material group consisting of lyocell, linen, high wet modulus rayon and cupramonium rayon.

19. A method according to claim 14, comprising the further step of applying a softening agent to the fabric subsequent to fluid treatment.

20. A method according to claim 14, wherein the continuous curtain of fluid is provided by an array of densely spaced liquid jets which impact the fabric with an energy in the range of $1.2\times10^6$ to $3.5\times10^7$ joule/Kg (0.2 to 6.0 hp-hr/lb).

21. A method according to claim 20, wherein the jets are columnar, the jet orifices have an entrance diameter of 0.0081 to 0.023 cm (0.0032 to 0.009 inches), and center-to-center spacing of 0.024 to 0.064 cm (0.0096 to 0.025 inches), and jet pressure is from 3,450 to 20,700 kPa (500 to 3000 psi).

22. A method according to claim 20, wherein the jets eject divergent, fan sprays having an angle of divergence so as to provide overlapping jets of liquid.

23. A method according to claim 1, comprising the further step of tentering the fabric prior to fluid treatment.

24. A method according to claim 20, wherein the liquid jets are arranged in staggered linear arrays.

25. A method for finishing textile fabric including fibrillatable cellulosic fibers, the method comprising the steps of:

supporting the fabric on an open width non-porous support member, and uniformly and continuously impacting at least one side of the fabric with a continuous curtain of fluid with a sufficient energy to fibrillate fibers in the fabric.

26. A method according to claim 25, comprising the further step of applying an enzyme to the fabric.

27. A method according to claim 25, comprising the further step of wet processing the fabric.

28. A method according to claim 25, comprising the further step of ultrasonically treating the fabric.

29. A method according to claim 25, comprising the further steps of: saturating the fabric with a caustic solution prior to fluid treatment, and applying an enzyme to the fabric subsequent to fluid treatment to dissolve and strip excess fibrils in the fabric.

30. A method according to claim 27, wherein the wet processing step includes jet dyeing.

31. A method according to claim 25, comprising the further step of heat tentering the fabric subsequent to fluid treatment.

32. A method according to claim 25, wherein the fabric includes fibers selected from the material group consisting of lyocell, linen, high wet modulus rayon and cupramonium rayon.

33. A method according to claim 25, wherein the continuous curtain of fluid is provided by an array of densely spaced liquid jets which impact the fabric with an energy in the range of $1.2\times10^6$ to $3.5\times10^7$ joule/Kg (0.2 to 6.0 hp-hr/lb).

34. A method according to claim 33, wherein the jets are columnar, the jet orifices have an entrance diameter of 0.0081 to 0.023 cm (0.0032 to 0.009 inches), and center-to-center spacing of 0.024 to 0.064 cm (0.0096 to 0.025 inches), and jet pressure is from 3,450 to 20,700 kPa (500 to 3000 psi).

35. A method according to claim 33, wherein the jets eject divergent, fan sprays having an angle of divergence so as to provide overlapping jets of liquid.

* * * * *

UNITED STATES PATENT AND TRADEMARK OFFICE

CERTIFICATE OF CORRECTION

PATENT NO. : 5,983,469

DATED : 11/16/99

INVENTOR(S) : Beaty et al.

It is certified that error appears in the above-identified patent and that said Letters Patent is hereby corrected as shown below:

Column 4, delete lines 39-41 and replace with --Figs. 7A and B are photomicrographs at 226X magnification of a lyocell fabric hydraulically processed at a cumulative energy of 2.9 x $10^7$ joule/kg (5.0 hp-hr/lb) and subsequently wet processed in accordance with Example 1;--.

Column 4, delete lines 42-44 and replace with --Figs. 8A and B are photomicrographs at 226X magnification of a lyocell fabric hydraulically processed at a cumulative energy of 7.9 x $10^6$ joule/kg (1.4 hp-hr/lb) and subsequently wet processed in accordance with example 2;--.

Figure 9A:
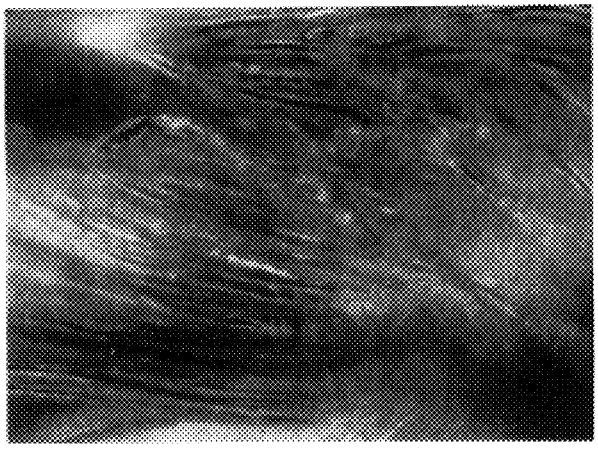
FIGS. 9A and B are photomicrographs at 226× magnification of a hydraulically pre-cursor and wet processed lyocell fabric in accordance with Example 3.
Figure 9B:
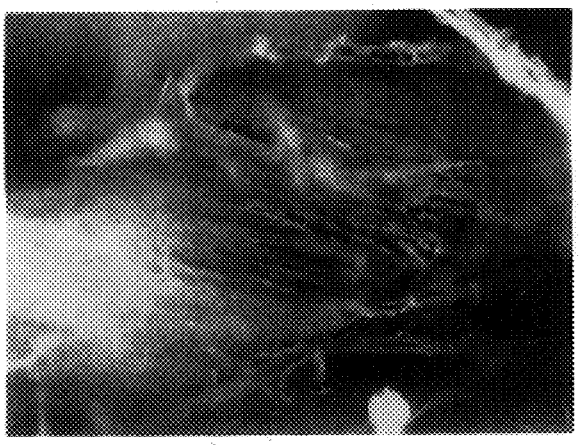

Column 4, delete lines 45-48 and replace with --Figs. 9A and B are photomicrographs at 226X magnification of a lyocell fabric hydraulically processed at a cumulative energy of 5.9 x $10^5$ joule/kg (0.1 hp-hr/lb) and subsequently wet processed in accordance with example 3;--.

Column 17, line 2, change "9 to 15" to --9 to 14--.

Signed and Sealed this

Sixth Day of June, 2000

*Attest:*

*Attesting Officer*

Q. TODD DICKINSON

*Director of Patents and Trademarks*